US005079593A

United States Patent [19]

Satoh et al.

[11] Patent Number: 5,079,593

[45] Date of Patent: Jan. 7, 1992

[54] TONER RECYCLING MECHANISM DETACHABLY CONNECTED TO A CARTRIDGE

[75] Inventors: Hisao Satoh; Koichi Endo, both of Hachioji, Japan

[73] Assignee: Konica Corporation, Tokyo, Japan

[21] Appl. No.: 463,778

[22] Filed: Jan. 8, 1990

Related U.S. Application Data

[63] Continuation-in-part of Ser. No. 366,169, Jun. 14, 1989, abandoned.

[30] Foreign Application Priority Data

Jun. 22, 1988 [JP] Japan ..... 63-155204

[51] Int. Cl.[5] ..... G03G 21/00; G03G 15/00

[52] U.S. Cl. ..... 355/298; 355/210

[58] Field of Search ..... 355/200, 298, 210, 211, 355/245, 260

[56] References Cited

U.S. PATENT DOCUMENTS

| | | | |
|---|---|---|---|
| 4,500,196 | 2/1985 | Shimura | 355/298 X |
| 4,724,459 | 2/1988 | Ford | 355/245 X |
| 4,752,805 | 6/1988 | Fukae et al. | 355/298 |
| 4,849,791 | 7/1989 | Hagihara et al. | 355/260 X |
| 4,894,688 | 1/1990 | Taniguchi et al. | 355/298 |
| 4,941,022 | 7/1990 | Ohmura et al. | 355/298 |
| 4,963,940 | 10/1990 | Nemoto et al. | 355/298 X |
| 5,017,962 | 5/1991 | Tsuji et al. | 355/210 |

FOREIGN PATENT DOCUMENTS

| | | | |
|---|---|---|---|
| 0061859 | 4/1984 | Japan | 355/210 |
| 0134273 | 7/1985 | Japan | 355/298 |
| 0008682 | 1/1988 | Japan | 355/298 |

*Primary Examiner*—A. T. Grimley
*Assistant Examiner*—Nestor R. Ramirez
*Attorney, Agent, or Firm*—Jordan B. Bierman

[57] ABSTRACT

An image forming apparatus having a photosensitive member unit, a development unit, and a toner recycling mechanism including a toner feed device. The photosensitive member unit includes a photosensitive member, and an electrostatic latent image forming device and a cleaning device disposed around the photosensitive member. The photosensitive member unit and the development unit are separately mounted in a main body of the apparatus to form an image forming section. The toner feed device is detachably connected between the front sides of the photosensitive member unit and the development unit, the toner collected by the cleaning means is transported to the development unit to perform recycling when the toner feed device is connected, and the photosensitive member unit and the development unit can be independently dismounted from the apparatus body when the toner feed device is detached. The toner feed device is automatically detached when the development unit is dismounted from the apparatus body.

8 Claims, 8 Drawing Sheets

TONER RECYCLING MECHANISM DETACHABLY CONNECTED TO A CARTRIDGE

CROSS-REFERENCE TO RELATED APPLICATION

This application is a continuation in part of copending application Ser. No. 366,169 filed on June 14, 1989 now abandoned.

BACKGROUND OF THE INVENTION

1. Field of the Invention

This invention relates to an image forming apparatus for performing development by using a developer in the form of a powder, and relates more particularly to a toner recycling mechanism provided in an image forming apparatus wherein a plurality of image forming means which constitute an image forming section are grouped into a photosensitive member unit and a development unit which units are detachably mounted in the apparatus body.

2. Description of the Prior Art

Recently, for image forming apparatus, e.g., electrophotographic reproducing machine for use in offices, a method of mounting various components is adopted wherein image forming means such as a photosensitive member, a charging device, developing device, a transfer device and a cleaning device are built in a common support frame for unitizing in order to improve the accuracy with which the components are positioned relative to each other and to facilitate maintenance, and the support frame is mounted in the apparatus body.

To form such components of the image forming section into a unit, a type of construction such as one disclosed in Japanese Patent Publication No. 63-10424 is ordinarily adopted in which the developing device is constructed as one unit separately from a unit of other components including a photosensitive member, a charging device, a transfer device and a cleaning device and is independently mounted in or detached from the apparatus body in consideration of the lifetime and the frequency of maintenance. However, the invention of Japanese Patent Publication No. 63-10424 has no mechanism for recycling the toner.

A type of image forming apparatus having toner recycling functions, such as one disclosed in Japanese Utility Model Publication No. 55-18843, is known. In this apparatus, the residual toner remaining on the photosensitive member is collected by the cleaning device after an image has been transferred, and the collected toner is supplied to the development device to be reused as developer. If this type of apparatus is designed to incorporate the cleaning device and the developing device in different units, a toner feeding means for connecting these devices must be detachably connected between the cleaning device and the developing device and must be of a movable type capable of retracting from one of the two units so as to enable the other only to be dismounted.

It is of course necessary to prevent the toner from leaking or spilling at the time of detachment or retracting of such a feeding means. Therefore the structure of a resulting toner recycling mechanism is necessarily complicated, and handling such a mechanism is troublesome.

An image forming apparatus wherein a photosensitive member, a developing device, a cleaning device and a toner recycling mechanism are formed as one unit and detachably mounted on the apparatus body, such as one disclosed in Japanese Patent Laid-Open No. 57-138652, is known.

However, in this invention all components are formed as one body, so that the apparatus becomes large in size and the operations of attaching and detaching become difficult. Further, in case that the photosensitive member is different in lifetime from the developing device, both are replaced at the same time according to the shorter lifetime, even if one of the photosensitive member and the developing device which is longer in lifetime can still be used.

SUMMARY OF THE INVENTION

In view of these problems, an object of the present invention is to provide an improved image forming apparatus having a recycling mechanism capable of enabling the toner feeding device to be easily detached by a simple operation as well as enabling the toner to be recycled with improved reliability without leaking or spilling.

To this end, the present invention provides an image forming apparatus having: a photosensitive member unit incorporating a photosensitive member, and an electrostatic latent image forming means and a cleaning device disposed around the photosensitive member; and a development unit, the photosensitive member unit and the development unit being separately and detachably mounted in an apparatus body, wherein a toner feed device for a toner recycling mechanism is detachably connected to at least one of the front sides of the photosensitive member unit and the development unit.

The present invention further provides an image forming apparatus having: a photosensitive member unit incorporating a photosensitive member, and an electrostatic latent image forming means and a cleaning device disposed around the photosensitive member; and a development unit, the photosensitive member unit and the development unit being separately and detachably mounted in an apparatus body, wherein a toner feed device for a toner recycling mechanism is detachably connected to at least one of the front sides of the photosensitive member unit and the development unit the toner feed device being automatically detached when the development unit is dismounted from the apparatus body.

DESCRIPTION OF THE PREFERRED EMBODIMENTS

An embodiment of the present invention will be described with reference to FIGS. 1 to 5.

Figure 4:
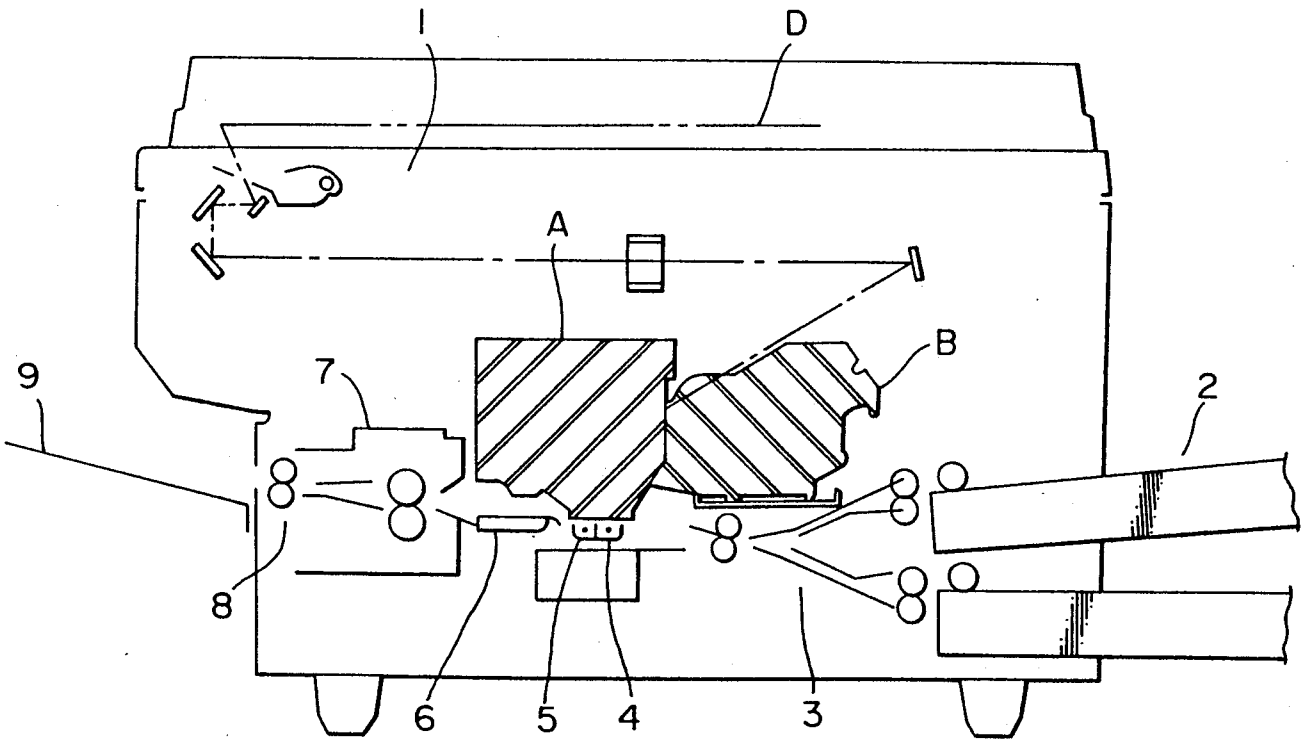
FIG. 4 is a schematic diagram of the construction of the image forming apparatus.

FIG. 4 schematically shows the construction of an image forming apparatus which represents an embodiment of the present invention. Among main components for image formation processing, a photosensitive member (drum or belt), an electrostatic latent image forming means disposed around the photosensitive member and including an exposure device before charging, a charging device and a charge eliminating device, and a cleaning device or cleaning means are housed in a photosensitive member unit A, while a developing device is housed in a development unit B. These units A and B are mounted in an apparatus body.

The photosensitive member unit A is inserted into the apparatus body from the front side of the apparatus while being guided along a pair of left and right guide rails, and is positioned by engagement with guide pins.

The development unit B is placed on a development garage disposed in the apparatus body and pressed against the photosensitive member by an urging force of a pressing member.

After the photosensitive member unit A and the development unit B have been mounted in the apparatus body, the above-mentioned processing components housed and supported in the units A and B are connected to a power source or a driving unit provided in the apparatus body, thereby enabling image forming functions in association with other processing devices or members.

To form a copy of an image, the apparatus operates as described below. After the photosensitive member in the photosensitive member unit A has started rotating, the peripheral surface of the photosensitive member is uniformly charged to have a certain potential by the charging device, and the exposure device 1 scans the photosensitive member with an image of an original D, thereby forming an electrostatic latent image.

Then, in the development unit B, the developing device is operated so as to form a toner image from the electrostatic latent image on the peripheral surface of the photosensitive member. A transfer device 4 disposed in a lower portion of the apparatus body transfers the toner image to a transfer paper supplied from a paper cassette 2 via paper supplying device 3.

The transfer paper to which the toner image has been transferred is separated from the peripheral surface of the photosensitive member by an electrostatic separation electrode 5 and is transported to a fixing device 7 via a transportation device 6. After the image has been fixed by the fixing device 7, the paper is discharged by a paper discharging roller 8 to a paper discharge tray 9 disposed on the outside of the apparatus body.

The peripheral surface of the photosensitive member from which the transfer paper has been separated is processed in the cleaning device housed in the photosensitive member unit A to clean the peripheral surface by removing remaining toner thereon, and is further processed in the charging device before exposure to eliminate a residual potential, thereby making the photosensitive member ready for the next image formation process.

Figure 5:
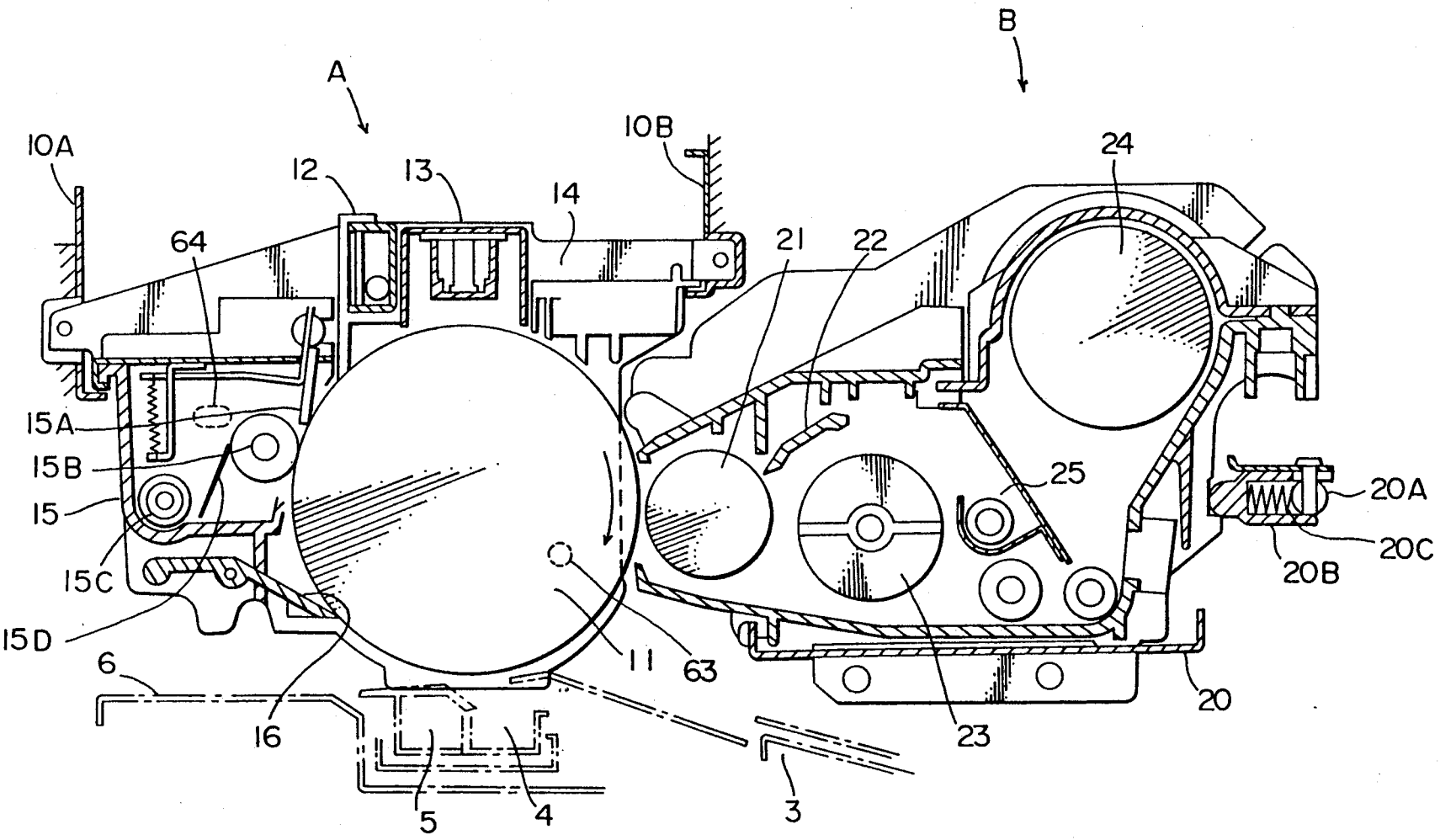
FIG. 5 is a cross-sectional view of an image forming section of the apparatus shown in FIG. 4.

FIG. 5 shows the constructions of the processing components in the photosensitive member unit A and the development unit B.

Figure 1:
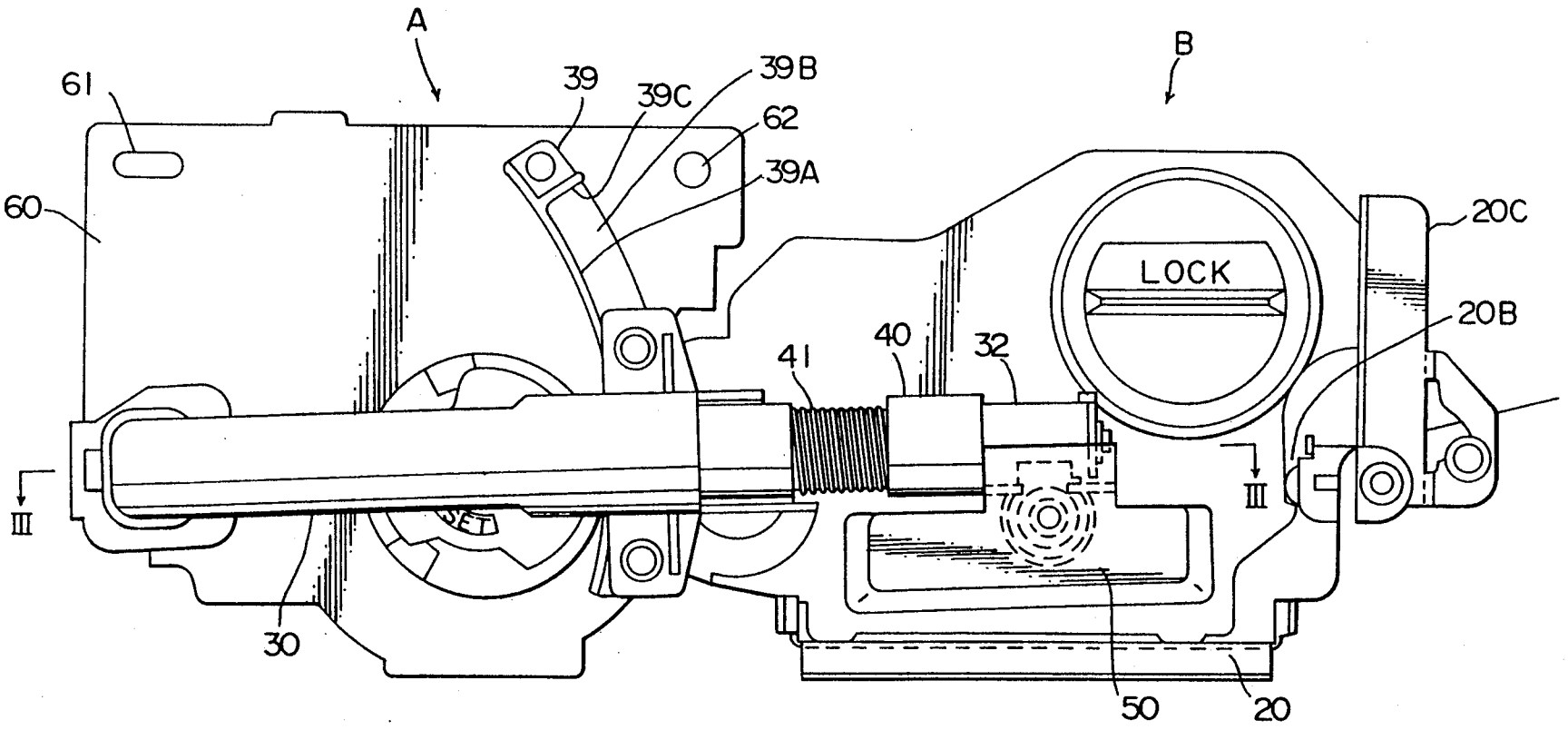
FIGS. 1 and 2 are front views of a toner recycling mechanism in an image forming apparatus in accordance with the present invention.

Reference characters 10A and 10B denote guide rails fixed on the apparatus body. The photosensitive member unit A is inserted into the apparatus body in such a manner that its opposite side portions slide on the guide rails 10A and 10B while being supported thereon. When the photosensitive member unit A is moved to a position immediately before its stop position, a pair of positioning holes 61 and 62 formed in a front side plate portion 60 of the photosensitive member unit A shown in FIG. 1 are brought into engagement with a pair of front guide pins P shown in FIG. 6 projecting from the front ends of the guide rails 10A and 10B, thereby positioning the photosensitive member unit A. The hole 61 is an elongated hole.

Figure 7:
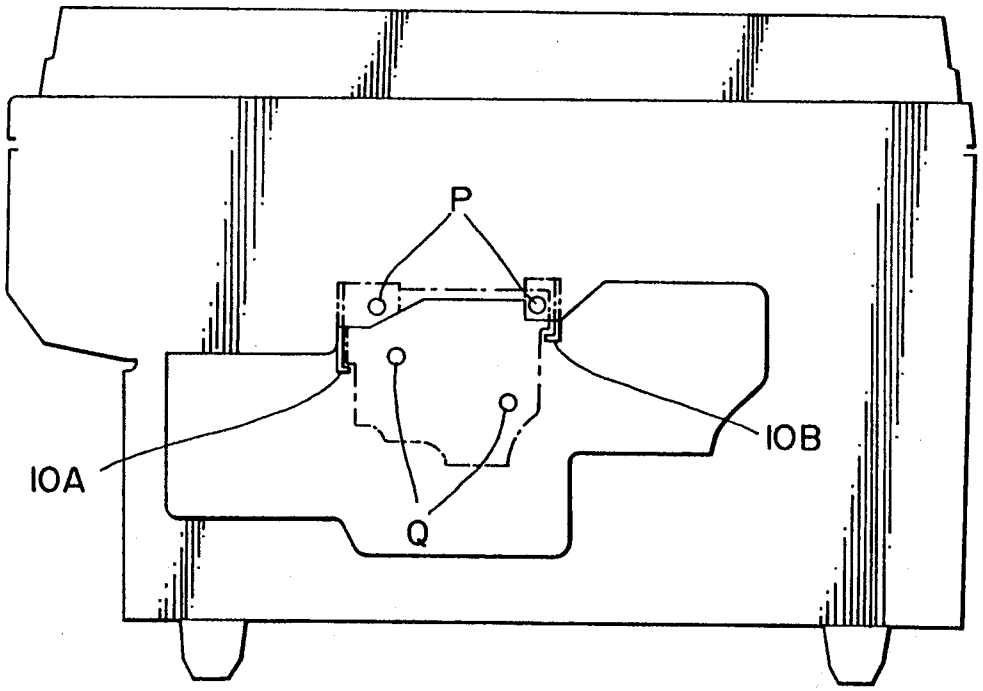
FIG. 7 is a front view thereof.
Figure 6:
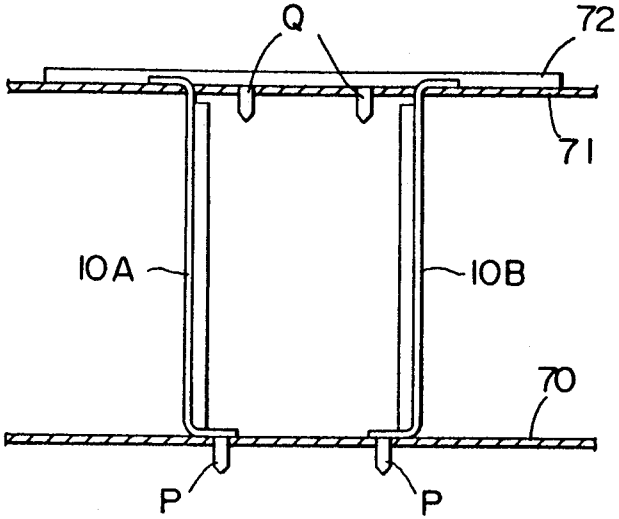
FIG. 6 is a plan view of an insertion guide portion of the photosensitive member unit.

A pair of back guide pins Q are disposed on a drive unit 72 and are brought into engagement with a pair of positioning holes 63 and 64 formed in the back side of the photosensitive member unit A as shown in FIGS. 6 and 7. The hole 64 is an elongated hole.

A reference character 11 denotes a photosensitive member in the form of a drum, a reference character 12 an exposure device before charging, a reference character 13 a charging device, a reference character 14 a charge eliminating device, a reference character 15 a cleaning device, and a reference character 16 a separation pawl. These components are rotatably supported or fixed between front and rear bases of the photosensitive member unit A.

The cleaning device 15 has a cleaning blade 15A which is pressed against the peripheral surface of the photosensitive member 11 to remove the residual toner remaining thereon, a toner feed roller 15B which rotates together with the photosensitive member 11 so as to prevent the removed toner from escaping from a receptacle for receiving the toner, a toner feed path 15C which is disposed to discharge the toner accumulated at the bottom of the receptacle to the outside of the apparatus, and a scraper 15D for scraping the toner attached to the toner feed roller 15B. A later-described toner discharge screw which is rotated by a driving unit provided in the apparatus body is incorporated in the toner feed path 15C.

A reference character 20 denotes a development garage fixed in the apparatus body. A rotary shaft 20A is stretched between base plates of the apparatus body. A pair of pressing shoes 20B are urged by compression springs 20C retained by the rotary shaft 20A at two places thereon. By rotating the rotary shaft 20A counterclockwise by the operation of a later-described pressing lever after the development unit B has been placed on the development garage 20, the development unit B is thereby slide on the development garage 20 leftward and is set and retained at its developing position by a later described positioning method, such steps as described in Japanese Patent Publication No. 59-28908 and Japanese Patent Application No. 62-131260.

The development unit B has a development sleeve 21, an ear regulating member 22 for limiting the amount of the toner on the development sleeve 21, an agitation rotor 23, a toner cartridge 24 which contains replenishment toner, a toner feed path 25 through which toner collected by a later-described recycling mechanism is transported, and a later-described toner feed-in screw incorporated in the toner feed path 25 and rotated by a driving unit provided in the apparatus body.

A distance between the development sleeve 21 and the photosensitive member 11 is set by pressing the development unit B. A method of cooperating these members may be selected as desired. For example, as disclosed in Japanese Patent Publication No. 59-28908, rollers coaxial with the development sleeve 21 are pressed against non-imaging surfaces of the photosensitive member 11, or, as proposed by the inventors of the present invention and disclosed in Japanese Patent Application No. 62-131260, the developer layer is directly pressed between the sleeve and the surface of the photosensitive member.

Figure 2:
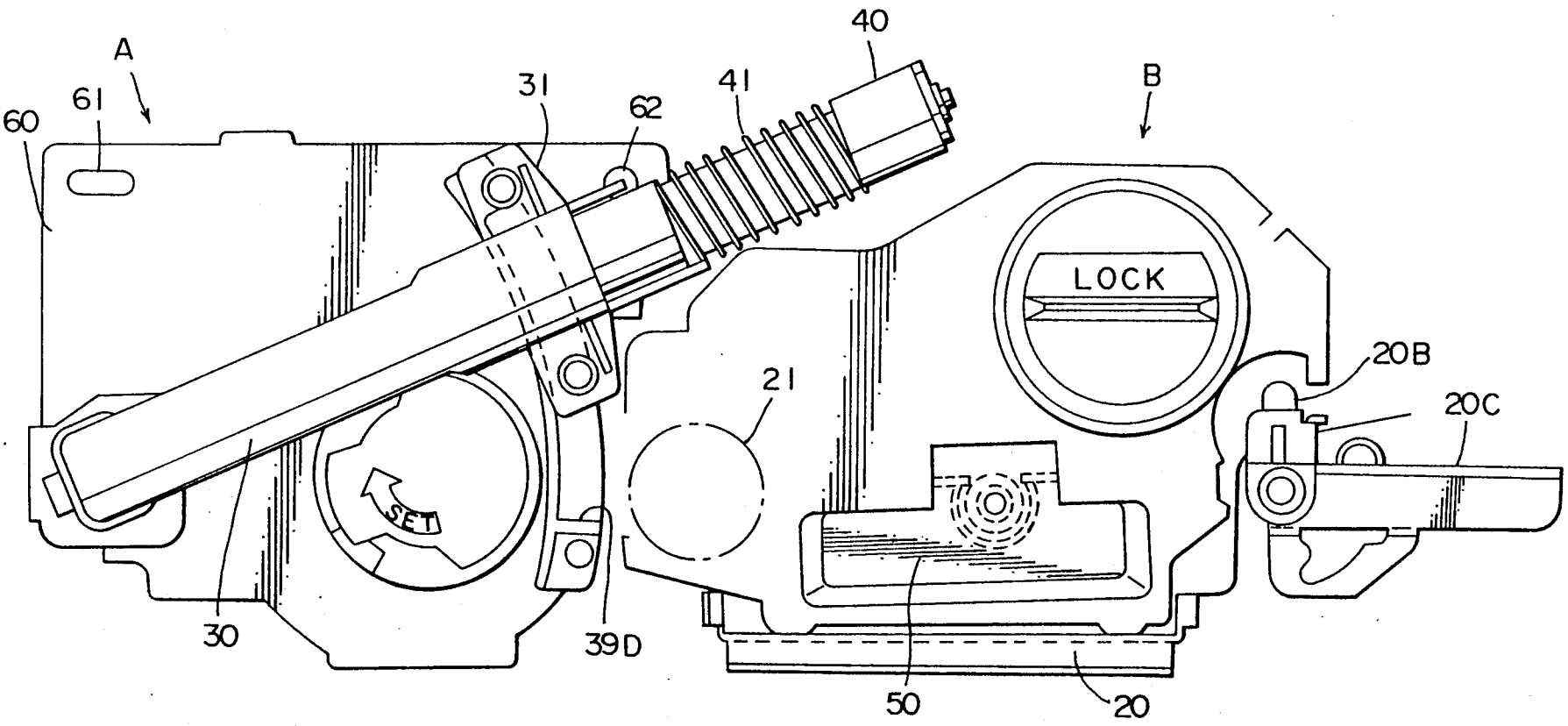
Figure 3:
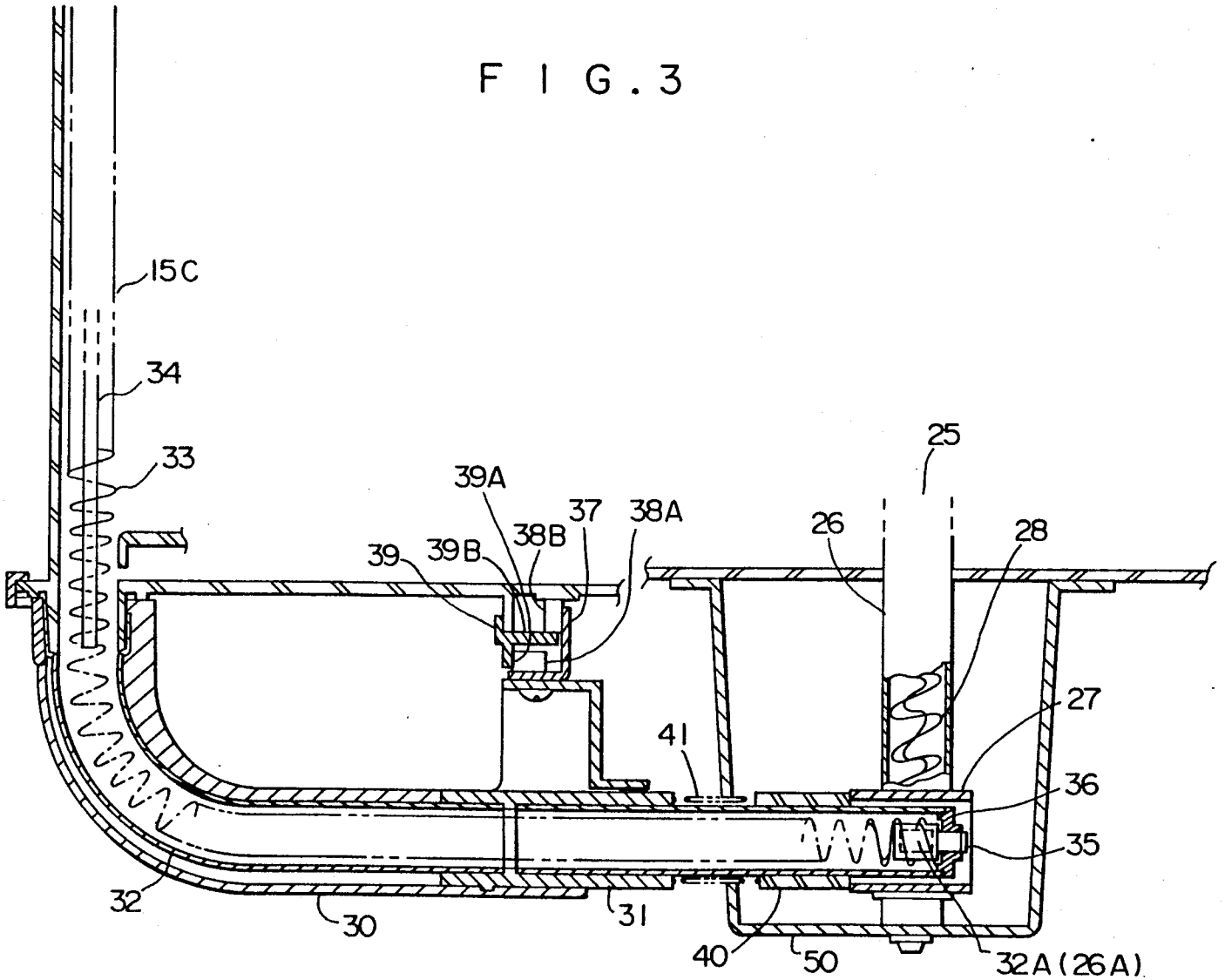
FIG. 3 is a cross-sectional view of essential portion of the toner recycling mechanism shown in FIG. 1.

FIGS. 1 to 3 show a toner recycling mechanism in accordance with the present invention provided between the photosensitive member unit A and the development unit B.

Referring first to FIG. 3 which shows a cross-section taken along the line III—III of FIG. 1, the recycling mechanism has an external tube 30 which forms an outer wall of a toner feed device (pipe) connected to the toner feed path 15C of the cleaning device 15 and which is rotatably disposed at the front side of the photosensitive member unit A, a handle portion 31 attached to an end of the external tube 30, and an inner tube 32 which forms an inner wall of the toner feed device and which protrudes beyond the handle portion 31.

A reference character 33 denotes a toner discharge screw that is a flexible member having a continuous helical surface and that is incorporated in the toner feed path 15C and the inner tube 32 so as to extend to the extreme end of the inner tube 32.

A shaft 34 for preventing the toner discharge screw 33 from shaking is secured at its one end to the cleaning device 15. A rotary shaft 35 is fixed to the other end of the toner discharge screw 33. The rotary shaft 35 is rotatably supported on a lid 36 in the form of a disk which closes the protruding end of the inner tube 32.

A shutter tube 40 which is slidable in the longitudinal direction of the inner tube 32 is urged by a compression spring 41 toward the protruding end of the inner tube 32. The shutter tube 40 is ordinarily positioned at the protruding end portion of the inner tube 32 by contacting with a projection (not shown) formed on an outer peripheral surface of the lid 36 by the action of the compression spring 41, thereby closing a toner fall opening 32A formed in a wall portion of the inner tube 32.

A toner feed device (pipe) 26 which is connected to the toner feed path 25 projects from the front side of the development unit B. A gutter-like receiving member 27 is formed integrally with the toner feed device 26 in the vicinity of the extreme end thereof so that its axis is perpendicular to that of the toner feed device 26. The receiving member 27 has an inner peripheral surface on which the protruding end portion of the inner tube 32 extending from the photosensitive member unit A can be received and supported stably.

A toner receiving opening 26A is formed in the receiving member 27 in such a manner that it generally coincides with the toner fall opening 32A. The toner falls downward through the toner fall opening 32A of the inner tube 32, enters the toner feed pipe 26 through the toner receiving opening 26A, and is transported to the toner feed path 25. A reference character 28 denotes a toner discharge screw that has substantially the same structure as the toner discharge screw 33 although it does not need to be so flexible.

FIG. 1 shows the front sides of the photosensitive member unit A and the development unit B when the toner recycling mechanism is operated.

As mentioned above, the external pipe 30 is rotated about its base portion relative to the photosensitive member unit A. This operation can be guided by means of below-described guide members in such a manner that the protruding end of the inner tube 32 is fittingly received on the receiving member 27 or is moved away from the same.

Referring to FIG. 3, a metallic roller support member 37 having an L-shaped cross section is fixed by screws to the handle portion 31. Rollers 38A and 38B are rotatably attached to the roller support member 37. An arched guide member 39 is provided which has guide surfaces 39A and 39B capable of contacting the rollers 38A and 38B, and upper and lower stop walls 39C and 39D shown in FIGS. 1 and 2. The rotation of the external tube 30 is guided by the guide member 39 so that while the locus of rotation and the stop positions are determined, the end of the inner tube 32 can be supported on the receiving member 27, as shown in FIG. 1, or moved away from the supported position by being rotated counterclockwise so as to separate from the section of the development unit B, as shown in FIG. 2.

To set the described recycling mechanism as shown in FIG. 1, the external pipe 30 is rotated clockwise by the operation of the handle portion 31 so that the inner tube 32 is supported on the receiving member 27. Immediately before the inner tube is supported, the shutter tube 40 is slid by manual operation against the urging force of the compression spring 41 so as to open the toner fall opening 32A. The slid shutter tube 40 is engaged with an end portion of the receiving member 27 so as to maintain the opened state of the toner fall opening 32A, thus making the inner tube 32 and the toner feed pipe 26 communicate with each other.

In this state, both the toner discharge screw 33 on the side of the photosensitive member unit A and the toner discharge screw 28 on the side of the development unit B start rotating, and the toner collected by the cleaning device 15 is transported through the toner feed path 15C and the inner tube 32, enters the toner feed pipe 26 by falling downward through the toner fall opening 32A, and is transported to the interior of the development device, thereafter being reused.

To release the recycling mechanism, as shown in FIG. 2, the external tube 30 is rotated counterclockwise, and the mechanism is retained in a position where the roller 38A is stopped by being abutted against the stop wall 39C, while the pressing lever 20C which is integrally connected to the rotary shaft 20A for retaining the pressing shoes 20B is rotated clockwise.

The pressing shoes 20B are turned upwardly and are released from the state in which they press the development unit B, thereby allowing the same to be moved rightward on the development garage 20.

Thereafter, the development unit B can be detached from the apparatus body by moving the development sleeve 21 away from the peripheral surface of the photosensitive member 11.

The operation of detaching the development unit B from the apparatus body is performed by holding a tray-like support 50 disposed on the front side of the development unit B. The support 50 thus used as a handle supports the toner feed device (pipe) 26.

During the above-described operation of the handle portion 31, the shutter tube 40 is released from engagement when the handle portion is slightly displaced for counterclockwise rotation, and the shutter tube 40 is thereby turned abruptly by the force of the compression spring 41 so as to close the toner fall opening 32A, thereby preventing the toner from escaping. After the recycling mechanism has been released, the external tube 30 is retained at a position slightly deviated clockwise from the position indicated in FIG. 1 by the roller 38A that has come into contact with the stop wall 39D and stopped.

As described above, the present invention realizes a construction of a toner recycling mechanism in which a feeding section of the toner recycling system for reusing the toner collected by the cleaning device by supplying the collected toner to the development device can be freely connected or detached by a simple operation, in which the possibility of leakage of the toner at the time of connection or detachment of the feeding section is eliminated, and in which the feeding functions can be automatically restored at the time of connection. The present invention thereby provides the image forming apparatus having the toner recycling mechanism that is provided in the image forming section constituted by the two independent units, i.e., the photosensitive member unit and the development unit, and that is capable of recovering and feeding the toner with improved efficiency and reliability.

Figure 8:
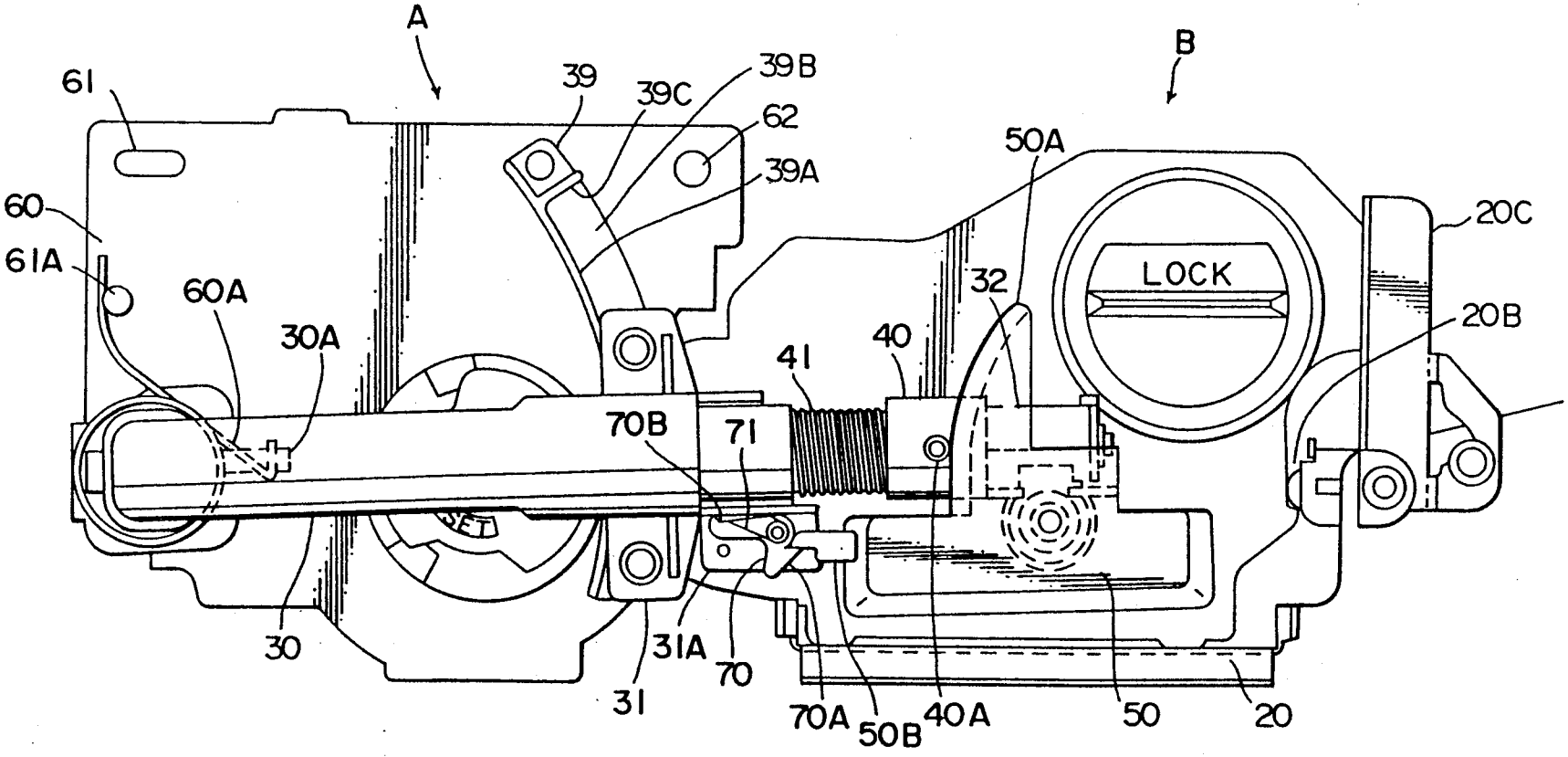
FIGS. 8 and 9 are front views of a toner recycling mechanism in an image forming apparatus of the other embodiment of the present invention.
Figure 9:
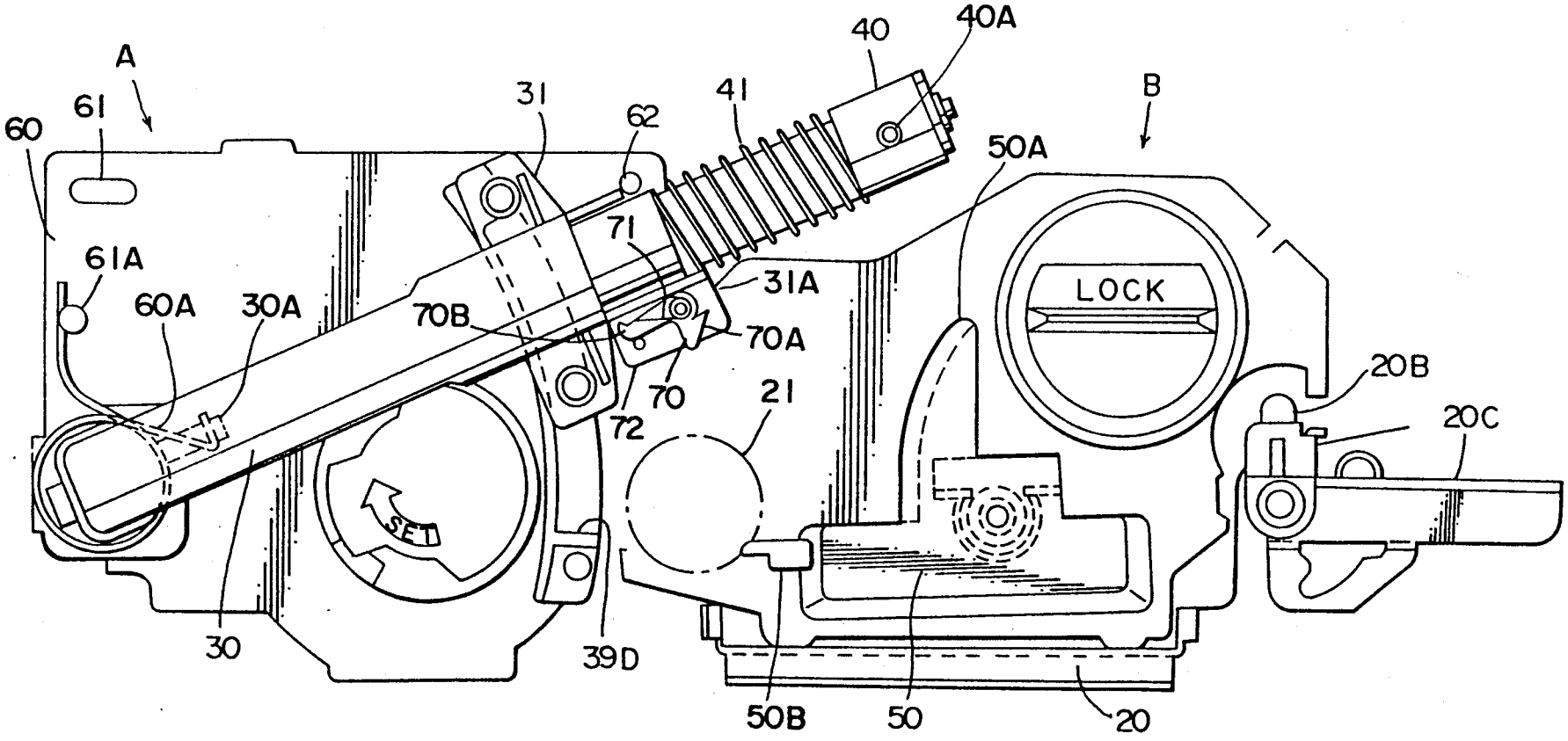

FIGS. 8 and 9 show a further embodiment of the present invention. In this embodiment, when the recycling mechanism is set, said external pipe 30 has been rotated clockwise against the spring action of a return spring 60A engaging between a base end pin 30A and a pin 61A provided on the photosensitive member unit A so that said inner tube 32 has been supported on said receiving member 27 held by the developing unit B, as shown in FIG. 8.

Specifically, a hook member 70 having a curved surface 70A formed on a lower vertical wall 31A thereof is rotatably supported by said handle portion 31. The hook member 70 is rotated counterclockwise normally by a return spring 71, so that when the recycling mechanism is reset a projecting portion 70B is brought into abutment with a stopper 72 as shown in FIG. 9.

Accordingly, when the external tube 30 is rotated clockwise from the reset position shown in FIG. 9, a pin 40A of the shutter tube 40 is brought into abutment with a cam surface 50A of the support 50, so that the shutter tube 40 is moved in the leftward direction to support the inner tube 32 on the receiving member 27 while opening the toner fall opening 32A.

At the same time, the curved surface 70A of the hook member 70 is urged by an engaging portion 50B provided on the support 50 when said external pipe 30 is rotated clockwise, so that the hook member 70 is rotated clockwise and then counterclockwise by the action of the return spring 71 to engage with said engaging portion 50B. Accordingly, the recycling mechanism is set as shown in FIG. 9.

The resetting of the recycling mechanism can be attained by separating the toner feed device automatically when the development unit B is removed from the apparatus body.

Specifically, when said shoe 20B is rotated about 90° in the clockwise direction by the compression spring pressing lever 20C connected to the rotary shaft 20A, the developing unit B is released from being urged in the leftward direction, so that the developing unit B can be moved in the rightward direction on the development garage 20 and taken out of the apparatus body.

When the developing unit B is moved in the rightward direction, said engaging portion 50B is disengaged from said hook member 70, so that the external tube 30 is rotated counterclockwise by the action of the return spring 60A. At the same time, the shutter tube 40 is released from being urged, because the pin 40A is removed from the cam surface 50A. Accordingly, the toner fall opening 32A is closed by the action of the compression spring 41, so that the recycling mechanism is reset automatically under the state that the toner is prevented from leaking.

Further, said external tube 30 is rotated centering around the base end thereof with respect to the photosensitive member unit A. The movement of the external tube 30 is guided by guide members explained hereinafter so that the tip end of the inner tube 32 can be brought into engagement with the receiving member 27 suitably and precisely or can be removed therefrom.

What is claimed is:

1. An image forming apparatus comprising:

a) a photosensitive unit, detachably mounted in said image forming apparatus, said photosensitive unit comprising
   a photosensitive member, and
   a cleaning device to collect residual toner remaining on said photosensitive member after transferring of a toner image formed on said photosensitive member to a transfer material;

b) a development unit for developing an electrostatic latent image on said photosensitive member wherein said development unit stores said residual toner therein, and is detachably mounted in said image forming apparatus; and c) a toner feed device having a first end portion and a second end portion, said toner feed device being connected to said photosensitive unit at said first end portion, and connected to said development unit at said second end portion, so that said residual toner can be carried to said development unit, either of said first end portion or said second end portion being pivotally connected and the other end portion being detachably connected so that either of said photosensitive unit or said development unit can be detached from said image forming apparatus without detaching the other.

2. The apparatus of claim 1 wherein said first end portion is pivotally connected to said cleaning device and said second end portion is detachably connected to said development unit.

3. The apparatus of claim 2 further comprising pivoting device for automatically pivoting said toner feed device so that said development unit can be removed from said image forming apparatus when said second end portion is detached from said development unit.

4. The apparatus of claim 2 wherein said toner feed device comprises a spring for biasing said toner feed device toward a position in which said toner feed device does not interfere with removal of said development unit.

5. The apparatus of claim 2 wherein said toner feed device comprises a toner fall opening and a shutter which shutter opens said toner fall opening when said second end portion and said development unit are connected and closes said opening when said second end portion and said development unit are detached.

6. The apparatus of claim 8 further comprising a retainer for releasably retaining said development unit at a developing position, said retainer being arranged so that said development unit is urged toward said photosensitive member unit.

7. The apparatus of claim 6 wherein said photosensitive unit comprises a selector for selecting a position of said toner feed device wherein said selector selects between a first position where said development unit can be removed from said developing position and a second position where said toner feed device is connected with said development unit.

8. An image forming apparatus comprising:

a) a photosensitive unit, detachably mounted in said image forming apparatus, said photosensitive unit comprising a photosensitive member, and a cleaning device to collect residual toner remaining on said photosensitive member after transferring of a toner image formed on said photosensitive member to a transfer material;

b) a development unit for developing an electrostatic latent image on said photosensitive member wherein said development unit stores said residual toner therein, and is detachably mounted in said image forming apparatus; and c) a toner feed device having a first end portion and a second end portion, said toner feed device being connected to said photosensitive unit at said first end portion, and connected to said development unit at said second end portion, so that said residual toner can be carried to said development unit, said first end portion and said second end portion being detachably connected to each of said photosensitive unit and said development unit so that either of said photosensitive unit or said development unit can be detached from said image forming apparatus without detaching the other.

* * * * *